US005639072A

United States Patent [19]

McCall

[11] Patent Number: 5,639,072

[45] Date of Patent: Jun. 17, 1997

[54] COMPRESSIONALLY ELASTIC PLASTIC BUMPERS FOR FURNITURE EDGES

[76] Inventor: Gary W. McCall, 57 Ventura St., Vallejo, Calif. 94590

[21] Appl. No.: 519,946

[22] Filed: Aug. 28, 1995

[51] Int. Cl.[6] ..... A47B 97/00

[52] U.S. Cl. ..... 267/139; 248/345.1

[58] Field of Search ..... 248/345.1; 267/139, 267/140; 297/219.1, 228.13; 5/663

[56] References Cited

U.S. PATENT DOCUMENTS

| | | | |
|---|---|---|---|
| 4,109,887 | 8/1978 | Wakeland, Jr. | 248/345.1 |
| 4,582,739 | 4/1986 | Givens | 248/345.1 |
| 5,081,725 | 1/1992 | Neese | 248/345.1 |
| 5,125,704 | 6/1992 | Perechodnik | 248/345.1 |
| 5,170,971 | 12/1992 | Schaeffer et al. | 248/345.1 |
| 5,271,662 | 12/1993 | Saul | 248/345.1 |

FOREIGN PATENT DOCUMENTS

| | | | |
|---|---|---|---|
| 2048223 | 3/1972 | Germany | 248/345.1 |

*Primary Examiner*—Robert J. Oberleitner
*Assistant Examiner*—Chris Schwartz

[57] ABSTRACT

The present invention relates to a bumper that can be releasably attached to planar edges of furniture such as edges of a cocktail table, end table, library table or the like. The bumper comprises a cushion circumscribed by an appropriately seemed outer cover, the bumper being in the form of a modified cylinder of length L. Preferably, the bumper is of either of a solid or hollow form. In one aspect, the solid cylindrical form of the bumper is modified by providing a minor sector cut-out centered along its axis of formation and extending along its length L. The cut-out defines an included angle of 90 degrees. Hence, the major sector circumference of bumper that remains, defines a circumferential angle of 270 degrees as well as provided a pair of interior, normal faces or walls. In another aspect, the cylindrical form is hollow and modified to provide a longitudinal slot along its length. Attachment of the bumper relative to the edges of the table is provided by a series of selective releasable Velco-type fasteners. Each fastener comprises a planar hook section in which the broad surface opposite the hook surface is attached to either the table edge or to the wall surface or surfaces of the bumper, and a planar loop section in which the broad surface opposite the loop surface is attached to the other element of each fastener.

3 Claims, 4 Drawing Sheets

COMPRESSIONALLY ELASTIC PLASTIC BUMPERS FOR FURNITURE EDGES

SCOPE OF THE INVENTION

The present invention relates to plastic bumpers for furniture edges and more particularly to a bumper of modified cylindrical form positionable at terminating edges of furniture to cushion impact with children's anatomy thereon.

In one aspect, the bumper of the invention defines a covered cushion in the form of a modified solid cylinder having a central axis of formation about which a minor 90 degree cut-out has been removed, thereby providing a pair of interior, rectangularly shaped faces or walls that can be utilized to releasably contact at the terminating edge of furniture to be protected from contact with a child, such protection extending along the entire length of the support.

In another aspect, the cylindrical cushion is hollow (instead of solid) defining a side wall having a longitudinal slit along its entire length thereby providing a flexible longitudinal opening that enters over and prevents direct contact of the terminating with the child. Such protection also extends along the entire length of the support.

In yet another aspect, assume that if the radius R of the cushion is 1.5 inches, and its wall thickness is at least 1 inch, then the limit of radial elastic compressional deflection inwardly toward its axis of symmetry (using ASTM's D-3574 procedure—called "Indection Load Detection"—which measures the resistance of the cushion to deflection) is always less than the radius R. Hence, a child's anatomy is fully protected if the child's head, arm, chest etc. accidently comes into contact with the bumper of the invention. That is to say, the limit of radial elastic compressional deflection toward the axis of formation of the cushion can be defined using ASTM D-3574, a procedure for measuring the resistance of plastic to deflection. Also the cushion can be comprised of polyester foam or void-containing polyester, formed, for example, using a polyester resin and diisocyanaate acid reaction to form a resin prepolymer which then reacts with water to form a urethane polymer. Since carbon dioxide is also formed in the reaction, its presence causes the urethane resin to be cellular. An equivalent polyeaster foam is provided as foam LA 80-400-815 manufactured by Crain Industries, San Leandro, Calif., such foam having a compression number in the range of 75–80 when tested in accordance with the procedures set forth in ASTM D-3574. When the cushion is formed of such a foam, then the compressional deflection of the cushion is always less than the radius R.

BACKGROUND OF THE INVENTION

Loss of balance by young children around furniture is a parent's constant worry. As a child tottles around table edges, visions of injuries to such child, is stressful to the attending parent (or grandparent). It is therefore evident that protective paraphernalia, preferably decouplable, that could be attached to the edges of furniture would be helpful in reducing stress to the child attendant. Additionally, if the limit of radial elastic compressional deflection of the protective device, say using ASTM's D-3574 procedure for measuring deflection of plastic, is always below that value produced by a child's anatomy falling against such device, injuries are prevented.

SUMMARY OF THE INVENTION

The present invention relates to a bumper that can be releasably attached to parametric edges of furniture such as edges of ocktail tables, end tables, library tables or the like. The bumper comprises a cushion circumscribed by an appropriately seamed outer cover, the bumper being a modified cylinder of length L and being composed of a polyester foam having a relatively high ASTM D-3574 compression number, say in a range of 70 to 85 with 75 to 80 being preferred. The bumper is of either of a solid or hollow form. In one aspect, the solid cylindrical form of the bumper is modified by providing a minor sector cut-out centered along its axis of formation and extending along its length L. The cut-out defines an included angle of 90 degrees. Hence, the major sector circumference of bumper that remains, defines a circumferential angle of 270 degrees as well as provides a pair of interior, normal faces or walls which are releasable positioned at the terminating edge of the table to be protected. In another aspect, the cylindrical form is hollow and modified to provide a longitudinal slot along its length. In either embodiment, attachment of the bumper relative to the edge of the table is provided by a series of selective releasable Velco-type fasteners. Each fastener comprises a planar hook section in which the broad surface opposite the hook surface is attached to either the table edge or to the wall surface or surfaces of the bumper, and a planar loop section in which the broad surface opposite the loop surface is attached to the other element of each fastener.

DETAILED DESCRIPTION OF THE INVENTION

Figure 1:
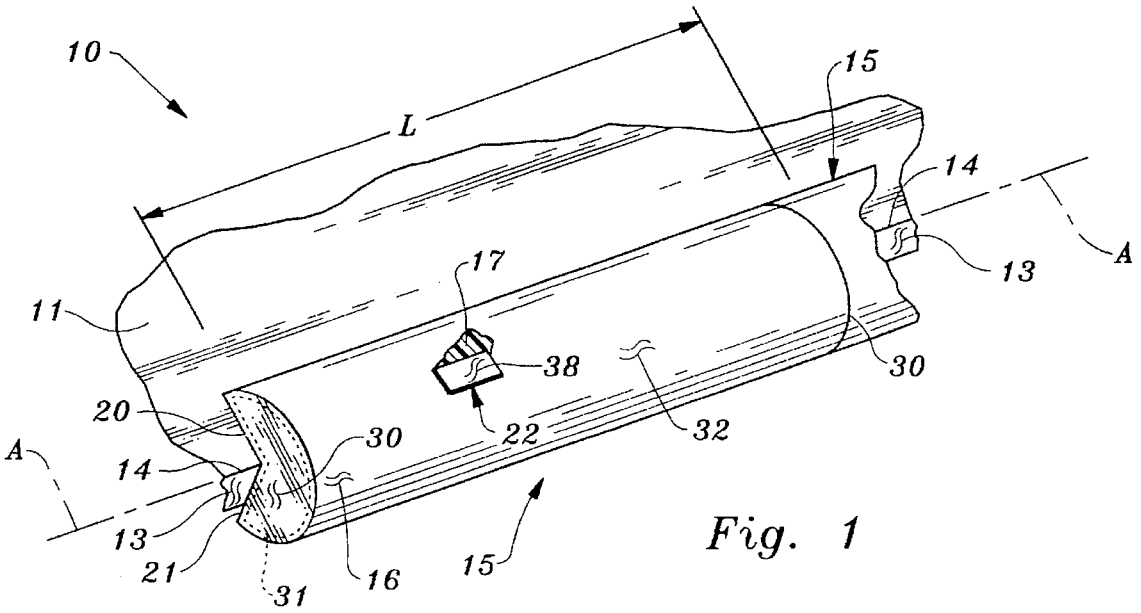
FIG. 1 is an isometric view of an edge of an end table to which is attached a linear version of the bumper of the invention cut-away to show a loop section of the Velcro fastener attached to the broad surface of the end table.

FIG. 1 is a perspective view of end table 10 of rectangular or square cross section having a broad horizontal upper surface 11. The upper surface 11 terminates in a downwardly projecting vertical surface 13 that defines the parameter of the table 10, viz. being associated with front edge 8, rear edge 9 as well as a pair of side edges (not shown). At intersection 14 of the horizontal and vertical surfaces 11, 13, is a series of straight-line, linear bumpers 15 of the invention aligned end-to-end. Since the edge 14 is continuous, a similar alignment of bumpers 15 can be placed along the rear edge 9 of the table 10 as well as along side edges (not shown).

Each of the bumpers 15 is in the form of a modified cylinder of longitudinal length L defining an axis of formation A normal to radial axis of symmetry 7, wherein the axis of formation A is seen to be coincident with the intersection 14 between the horizontal and vertical surface 11 and 13 of the table 10. Each bumper 15 includes a cover 16 circumscribing an interior cushion 17, such cushion including a semi-circular cross section provided by disgorging a minor cut-out section 18 (shown in phantom line in FIG. 2) from the circular shape of the regular solid cylindrical cross section. Such cut-out 18 defines an angle B equal to 90 degrees and as a result defines a pair of wall surfaces 20, 21 of radial extent R associated with a main sectored section 22. Such section 22A includes an included angle C equal to 270 degrees that defines the circumference of the section 22. Returning to FIG. 1, these wall surfaces 20, 21 disconnectably connect to the broad, planar horizontal and vertical surfaces, 11, 13 of the end table 10 via a series of conventional Velco fasteners 22 such as shown in U.S. Pat. No. 5,170,971, and as explained in more detail below to effect contact between the series of bumpers 15 and the table 10.

Figure 2:
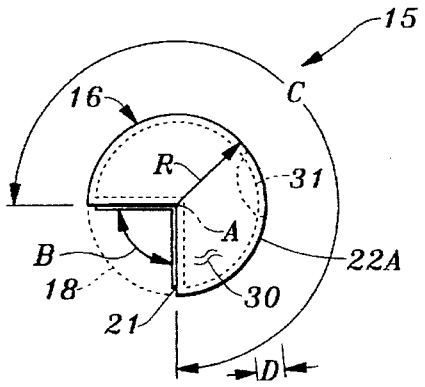
FIG. 2 is an end view of the bumper of the FIG. 1 decoupled from the end table thereof.
Figure 3:
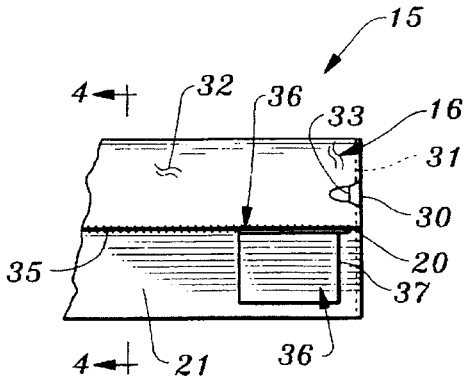
FIG. 3 is a partial side view of the bumper of FIG. 2 illustrating attachment of the hook sections of the Velcro type fastener to the side walls of the bumper via seams.
Figure 4:
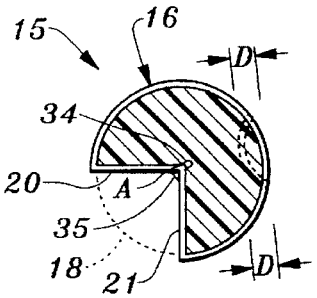
FIG. 4 is a section taken along line 4—4 of FIG. 3.

FIG. 2–4 show bumper 15 in more detail.

As shown, the cover 16 of bumper 15 includes a pair of end flaps 30 each sewn along a circumferential extending end seam 31 to a circumferential extending main section 32. Such end seam 31 attaches side edges 33 of the end flap 30 relative to the main section 32. In turn, longitudinal edges 34 of the main section 32 attach together along longitudinal seam 35, see FIG. 3. Continuing with FIG. 3, wall surface 20, 21 of the cover 16 are provided with a series of rectangularly shaped hook sections 36 of the Velco fasteners 22 of FIG. 1. Attachment thereof is via a conventional adhesive at the undersurface 37 of each hook section 36.

Figure 5:
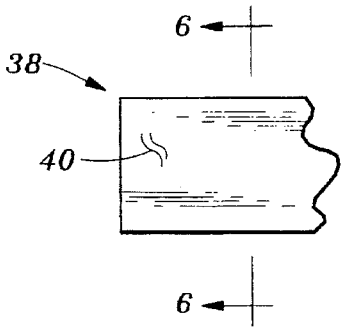
FIG. 5 is a detail of the loop section of the Velcro fastener of FIG. 1 prior to its attachment to the broad surface of the end table of FIG. 1.
Figure 6:
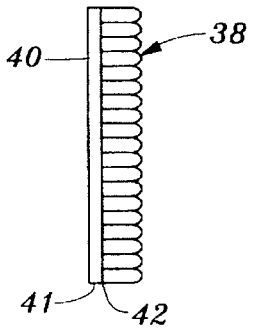
FIG. 6 is an enlarged section taken along line 6—6 of FIG. 5.

Returning to FIG. 1, note that the depicted Velco fastener 22 includes an associated loop section 38 which is attached to the end table 10 as shown by removing a tab cover 40, see FIGS. 5 and 6 to expose adhesive 41 at the underside 42 of the loop section 38 and then affixing the latter to the surface of the end table. Note that the loop sections 38 and associated hook sections 36 of FIG. 3 can be releasably attached to each other in conventional manner whereby the bumper 15 can be attached to the end table 10 to protect any falling child from injury by falling against same.

In this regard, note in FIGS. 2 and 4 that if the radius R of the interior cushion 17 is 1.5 inches and the active section circumference is 7.07 inches, then the limit of radial elastic compressional deflection D of the cushion 17 toward its axis of formation A can be defined using ASTM's D-3574 procedure for measuring the resistance of plastic to deflection. Assuming that cushion 17 is composed of a polyester foam having a ASTM D-3574 compression number in a range of 70 to 85 with 75 to 80 being preferred, such as foam LA 80-400-815 manufactured by Crain Industries, San Leandro, Calif., then the compressional deflection D is always less than the radius R. Hence, a child's anatomy is fully protected if the child's head, arm, chest etc. accidently comes into contact with the bumper of the invention.

SECOND EMBODIMENT

Figure 7:
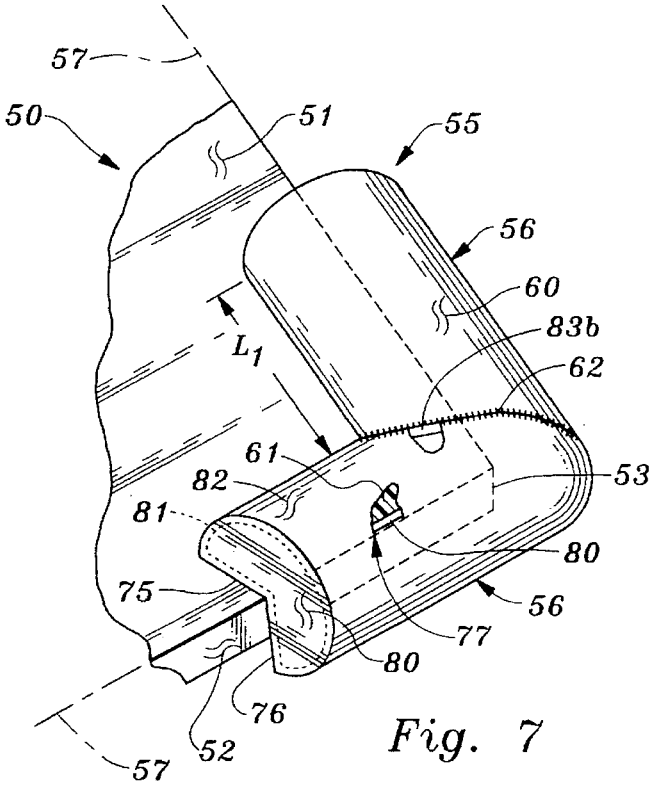
FIG. 7 is an isometric view of a corner of an end table to which is attached a 90 degree elbow version of the bumper of the invention cut-away to show a loop section of the Velcro fastener attached to the broad surface of the end table.

FIG. 7 is a perspective view of another end table 50 having a broad horizontal upper surface 51, a vertically descending side surface 52 and a corner 53 about which a 90 degree elbow bumper 55 of the invention, is attached.

Figure 13:
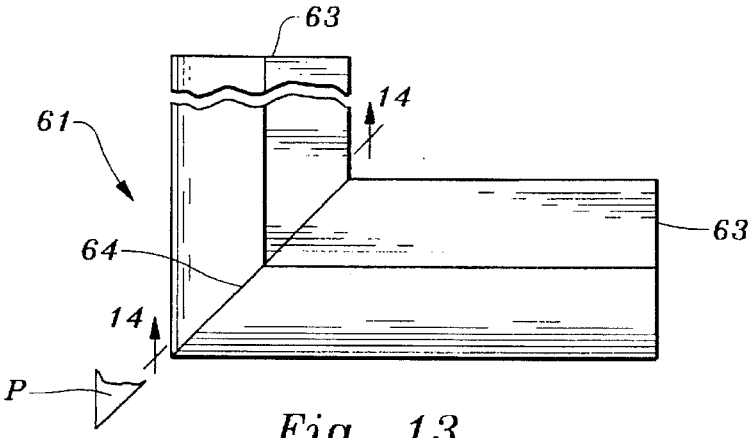
FIG. 13 is a detailed bottom view of the cushion of the bumper of FIG. 10 showing bifurcated form of the former.

Elbow bumper 55 is L-shaped in cross section and includes first and second arm 56 at right angles to each other. Each arm 56 defines an axis of formation 57 which intersects radial axis of symmetry 49 of the each bumper 55 at corner 53, and is constructed such that its axis of formation 57 also intersects the associated axis of formation 57 of the other arm 56 at corner 53; each arm 56 is also in the form of a modified cylinder of longitudinal minimum length L1. Each arm 56 also includes a L-shaped cover 60 each circumscribing an interior cushion 61, the cover 60 being sewn together along the full parametric angular seam 62. Note in FIGS. 13, the interior cushion 61 includes a first exterior end 63 and a remote angular end 64. The remote angular end 64 of the cushion 61 of each arm 56 each define an angle of 45 degrees and meet at interaction plane P. The cushion 61 is comprised of a high-density plastic foam such as a polyester foam formed as hereinbefore described.

Figure 8:
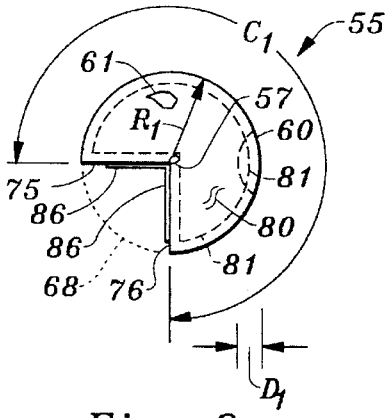
FIG. 8 is an end view of the bumper of the FIG. 7 decoupled from the end table thereof.
Figure 14:
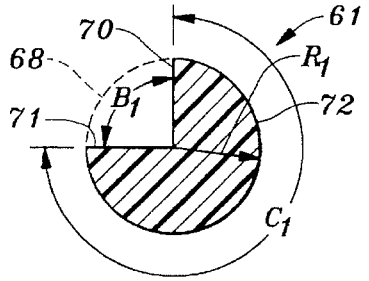
FIG. 14 is a section taken along line 14—14 of FIG. 13.

Note in FIGS. 8 and 14 that each cushion 61 includes a semi-circular cross section provided by disgorging a minor cut-out section 68 (shown in phantom line) from the circular shape of the regular solid cylinder. Such cut-out 68 also has an included angle B1 equal to 90 degrees and as a result defines a pair of wall surfaces 70, 71 of radial extend R1 associated with a main sectored section 72. Such section 72 includes an included angle C1 equal to 270 degrees. These wall surfaces 70, 71 are then covered with the cover 60 associated with each of the first and second arms 56.

Returning to FIG. 7, note that each cover 60 in the vicinity of the wall surfaces 70, 71 of the cushion 61 is provided with adjacent broad surfaces 75, 76 (FIG. 6) which disconnectable connect to the broad horizontal and vertical surfaces 51, 52 of the end table 50 via series of Velco fasteners 77 as explained in more detail below to effect contact between the elbow bumper 55 and the end table 50.

Figure 9:
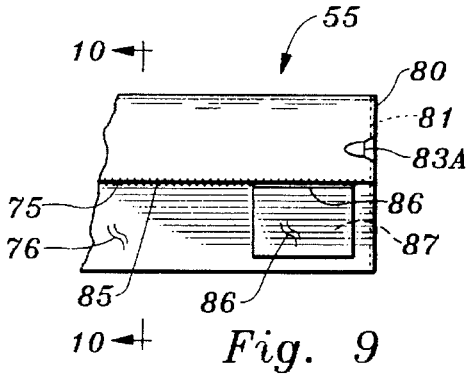
FIG. 9 is a partial side view of the bumper of FIG. 8 illustrating attachment of the hook sections of the Velcro type fastener to the side walls of the bumper via seams.
Figure 10:
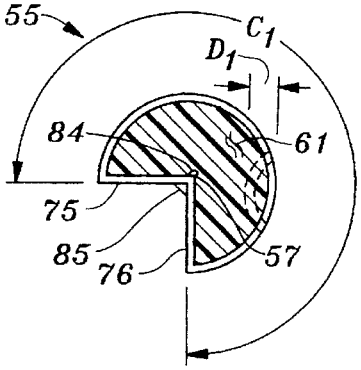
FIG. 10 is a section taken along line 10—10 of FIG. 9 showing an outer cover circumscribing an interior cushion.

FIGS. 8–10 show bumper 55 in more detail.

As shown, each of the pair of covers 60 associated with each of the first and second arms 56 includes an end flap 80. Each end flap 80 is sewn along circumferential extending end seam 81, such seams 81 being formed by overlapping adjacent edges together, sewing them and outwardly folding same so that the seam 81 is interior of the end flaps and circumferential extending main section 82. Such end seam 81 attaches to lapped side edges 83*a* of the end flap 80 and main section 82 (FIG. 9) to stabilize the former relative to the latter. In turn, as shown in FIG. 7, more distal edges 83*b* of the main section 82 attach together along the full extent of longitudinal seam 85 angular seam 82 previously mentioned. Thereafter, longitudinal edges 84 of the main section 82 as shown in FIG. 10 are attached along longitudinal seam 85.

As shown in FIG. 9, the broad surfaces 75, 76 of each cover 60 are provided with a series of rectangularly shaped hook sections 86 that form the second elements of the Velco fasteners 77. Attachment thereof is via a conventional adhesive located at undersurface 87 of each hook section 86.

Figure 11:
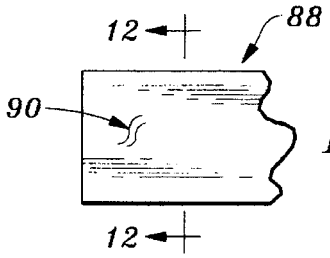
FIG. 11 is a detail of the loop section of the Velcro fastener of FIG. 7 prior to its attachment to the broad surface of the end table of FIG. 7.
Figure 12:
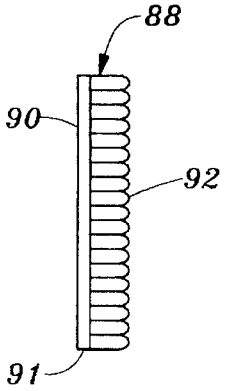
FIG. 12 is an enlarged section taken along line 12—12 of FIG. 11.

Returning to FIG. 7, note the positions of the series of loop sections 88. Such positions are first established relative to the top and side surfaces 51, 52 of the end table 50 so that they will coincide with the final positions of the hook sections 86 attached to the surfaces 75, 76 of the cover 60, see FIG. 9. Then tab cover 90 of each loop section 88, see FIGS. 11 and 12 is peeled back to expose adhesive 91 at the underside 92 of the loop section 88 and then affixing the latter to the end table 50. After such attachment, the loop sections 88 can be releasably attached to adjacently positioned hook sections 86, whereby the bumper 55 can be attached to the end table 50 to protect any falling child from injury by falling against the table 50 in the vicinity of the corner 53.

In this regard, note in FIGS. 8 and 10 that if the radius R1 of the interior cushion 61 is about 1.5 inches and the active sector circumference is 7.07 inches, then the limit of radial elastic compressional deflection D1 of the cushion 61 toward its axis of formation 57 can be defined using ASTM's D-3574 procedure or measuring the resistance of plastic to deflection. Assuming that cushion 61 is composed of a polyeaster foam having a ASTM D-3574 compression number in a range of 70 to 85 with 75 to 80 being preferred, such as foam LA 80-815 manufactured by Crain Industries, San Leandro, Calif., then the compressional deflection D1 is always less than the radius R1. Hence, a child's anatomy is fully protected if the child's head, arm, chest etc. accidently comes into contact with the bumper of the invention.

THIRD EMBODIMENT

Figure 15:
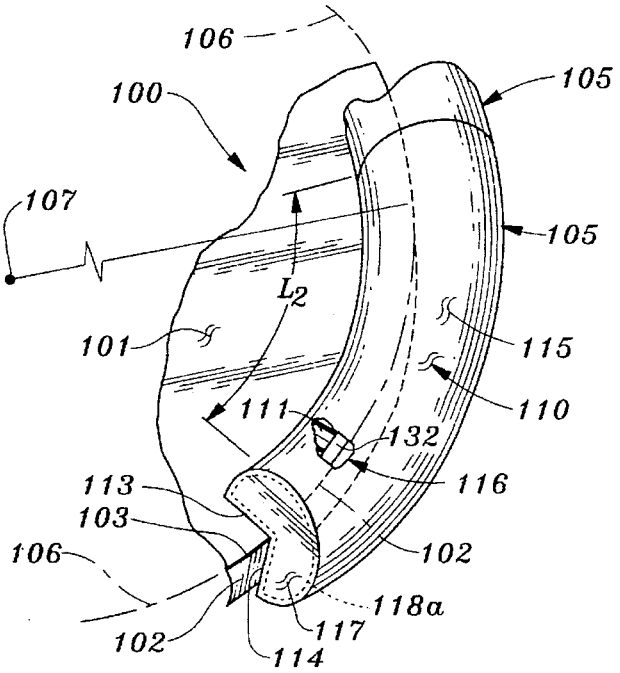
FIG. 15 is an isometric view of a rounded corner of an end table to which is attached a circular version of the bumper of the invention cut-away to show a loop section of the Velcro fastener attached to the broad surface of the end table.

FIG. 15 is a perspective view of a round table 100 having a broad horizontal upper surface 101, a vertically descending side surface 102 and a continuous terminating edge 103 therebetween. Note than the terminating edge 103 is circular in cross section being defined by radius 99 centered at center of formation 107 at the center of the table 100. Also positioned at the terminating edge 103, is a series of arcuately shaped (curved) bumpers 105 of the invention aligned end-to-end.

Each of the arcuate bumpers 105 is linearly curved about its curved axis of formation 106 coincident with terminating edge 103 of the table 100. Note that axis of formation 106 intersects radial axis of symmetry 98 at the mid-length of the bumper 105. Shapewise, each bumper 105 is in the form of a modified solid cylinder of longitudinal length L2 whose curvature is defined by the aforementioned center of formation 107 wherein radius 99 is centered as previously described and terminates at the edge 103 of the table 100.

Each bumper 105 includes a cover 110 circumscribing an interior cushion 111, and includes a semi-circular cross section provided by disgorging a minor cut-out section 112 (shown in phantom line in FIGS. 16 and 18) from the circular shape of the regular solid cylinder. Such cut-out 112 also has an included angle B2 equal to 90 degrees and as a result defines a pair of wall surfaces 113, 114 of radial extent R2 associated with a main sectored section 115. Such section 115 defines an included angle C2 equal to 270 degrees. Returning to FIG. 15, these wall surfaces 113, 114 disconnectably connect to the broad horizontal and vertical surfaces 113, 114 of the end table 100 via series of Velco fasteners 116 as explained in more detail below to effect contact between the series of bumpers 105 and the end table 100.

Figure 16:
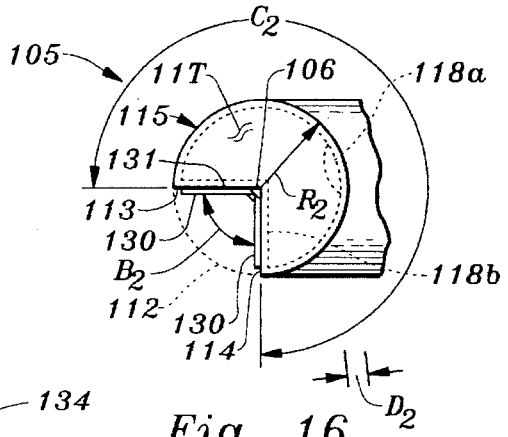
FIG. 16 is a partial end view of the bumper of the FIG. 15 decoupled from the end table thereof.
Figure 17:
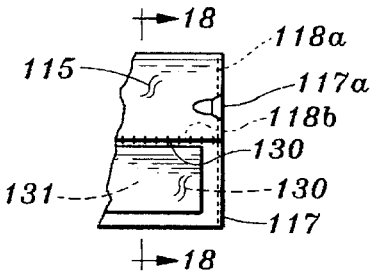
FIG. 17 is a partial side view of the bumper of FIG. 15 illustrating attachment of the hook sections of the Velcro type fastener to the side walls of the bumper via seams.
Figure 18:
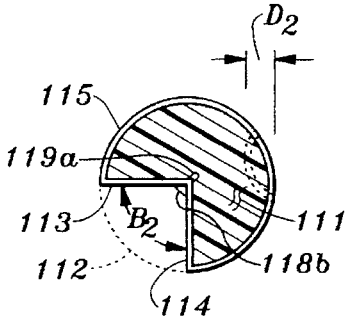
FIG. 18 is a section taken along line 18—18 of FIG. 17 showing an outer cover circumscribing an interior cushion.

FIGS. 16–18 show bumper 105 in more detail.

Each cover 110 of each bumper 105 is provided with foreshorten interior dimensions vs. its outer dimensions relative to center of formation 107 of FIG. 15 to force the interior cushion 111 into an arcuate shape, as shown. The cover 110 also includes a pair of end flaps 117 each sewn along a circumferential extending end seam 118*a* to the circumferential extending main section 115 previously mentioned. As shown in FIG. 17, such end seam 118*a* attaches lapped side edges 117*a* of the end flap 117 and the main section 115 relative to each other. In turn, longitudinal edges 119*a* (see FIG. 18) of the main section 115 attach together along longitudinal seam 118*b*.

Figure 21:
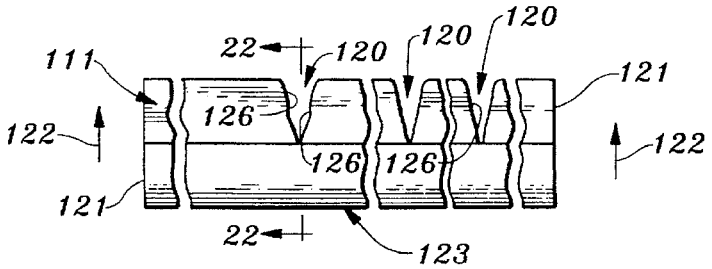
FIG. 21 is a detailed side view of the cushion of the bumper of FIG. 16 and 17 in which the cushion has been rotated 90 degrees thereover.

FIG. 21 shows the cushion 111 rotated 90 degrees in a clockwise from its depiction in FIG. 15 wherein a series of Vee slots 120 are provided along its entire length. As a result, when ends 121 of the cushion 111 are moved in the direction of arrows 122 relative to its center region 123 to fit with the foreshorten cover 110, there is sufficient flexibility in the cushion 111 to stabilize such positioning.

Figure 22:
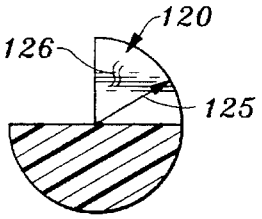
FIG. 22 is a section taken along line 22—22 of FIG. 21.

As shown in FIG. 22, each Vee slot 120 has a radius 125. Thus each slot 120 includes separate sectored wall surfaces 126, see FIG. 21 constructed such that when the ends 121 is moved in the directions of arrows 122, these broad wall surfaces 126 can be brought into broad contact with each other to provide the stabilized curvature position mentioned hereinbefore, say before the longitudinal seam 118*b* is provided of shown in FIGS. 16–18.

Figure 19:
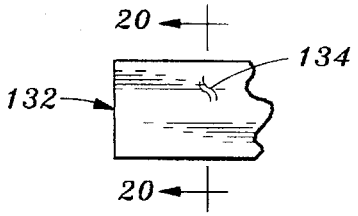
FIG. 19 is a detail of the loop section of the Velcro fastener of FIG. 15 prior to its attachment to the broad surface of the end table of FIG. 15.
Figure 20:
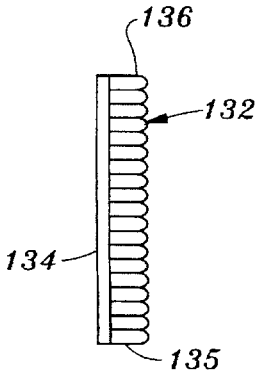
FIG. 20 is a section taken along line 20—20 of FIG. 19.

Returning to FIGS. 16 and 17 note that the wall surfaces 113, 14 of the bumper 105 are provided with a series of rectangularly shaped hook sections 130 comprising the second elements of the Velco fasteners 116 previously mentioned with respect to FIG. 15. Attachment thereof is via a conventional adhesive at each undersurface 131 of each hook section 130. Returning to FIG. 15, note that associated loop section 132 of each Velco fastener 116 is attached to the end table 100. Such attachments occur by removing or peeling off of tab covers 134, see FIGS. 19 and 20 to expose adhesive 135 at the underside 136 of the loop section 132 and then affixing the latter to the end table 100. In turn, the associated loop sections 132 can be releasably attached to adjacently positioned hook sections 130, see FIGS. 16 and 17, whereby the bumper 105 can be attached to the end table 100 to protect any falling child from injury by falling against same.

In this regard, note in FIG. 16 that if the radius R2 of the truncated bumper 105 is 1.5 inches and the active sector circumference is 7.07 inches, then the limit of radial elastic compressional deflection D2 of the bumper 105 toward its axis of formation 106 can be defined using ASTM's D-3574 procedure for measuring the resistance of plastic to deflection. Assuming that cushion 111 is composed of a polyeaster foam having a ASTM D-3574 compression number in a range of 70 to 85 with 75 to 80 being preferred, such as foam LA 80-400-815 manufactured by Crain Industries, San Leandro, Calif., then the compressional deflection D2 is always less than the radius R2. Hence, a child's anatomy is fully protected if the child's head, arm, chest etc. accidently comes into contact with the bumper of the invention.

FOURTH EMBODIMENT

Figure 23:
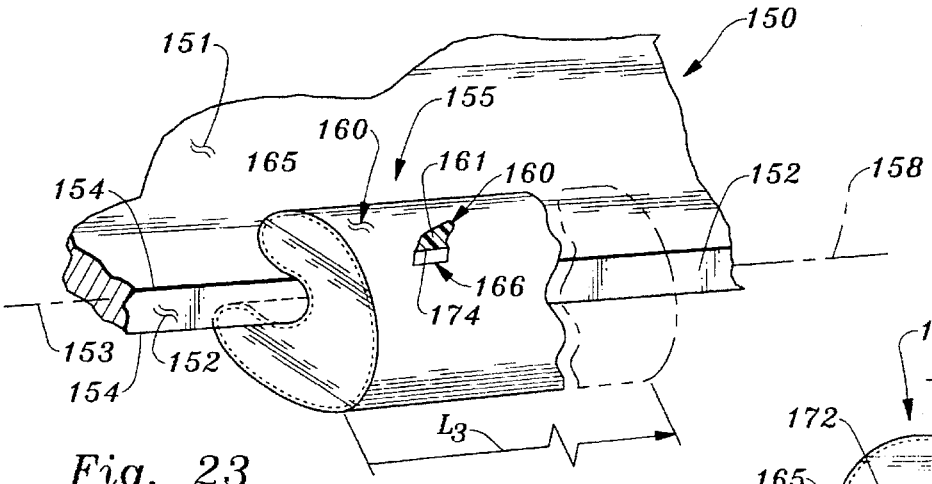
FIG. 23 is an isometric view of a linear edge of a cocktail table to which is attached another embodiment of the bumper of the invention cut-away to show a loop section of the Velcro fastener attached to the broad surface of the table.

FIG. 23 is a perspective view of a cocktail table 150 having a broad horizontal upper surface 151, a vertically descending side surface 152, a broad horizontal lower surface 153 parallel to upper surface 151 and a pair of intersections indicated at 154. Note that at the intersections 154, there is positioned a another embodiment of the bumper 155 of the invention.

The bumper 155 is in the form of a hollow cylinder of longitudinal length L3 defining an axis of formation 156 normal to radial axis of symmetry 149 located at the mid-length of the bumper 155. Note the axis of formation 156 is positioned is close proximity of the side edge 152 of the table 150. Note also that such positioning also places such axis of formation 156 in close proximity of the intersections 154 of the table 150.

Figure 29:
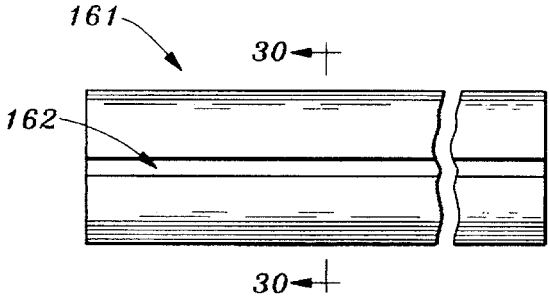
FIG. 29 is a detailed side view of the cushion of the bumper of FIG. 24 and 25.

Each bumper 155 includes a cover 160 circumscribing an interior cushion 161, and defines a C-shaped cross section, such section being provided by a longitudinal extending, slit 162 (shown in FIGS. 29 and 30) in side wall 163 interior of opening 164. Such slit 162 causes the cross section of the cushion 161 (usually circular) to change to a Cee shape as the cushion 161 relaxes. Such relaxation defines an exterior angle C3 of about 350 degrees. Returning to FIG. 23 as a result, there is defined a wall surface 165 of a tear-drop or horse shoe cross section that disconnectably connect to the upper and lower horizontal surfaces 151, 153 of the table 150 via series of Velco fasteners 166 as explained in more detail below to effect contact between the series of bumpers 155 and the table 150.

Figure 24:
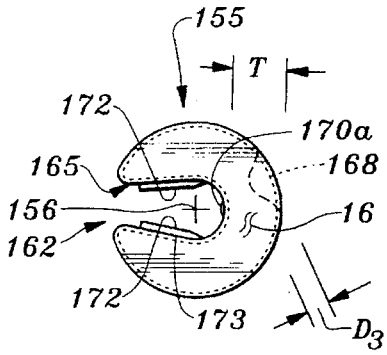
FIG. 24 is an end view of the bumper of the FIG. 23 decoupled from the table thereof.
Figure 25:
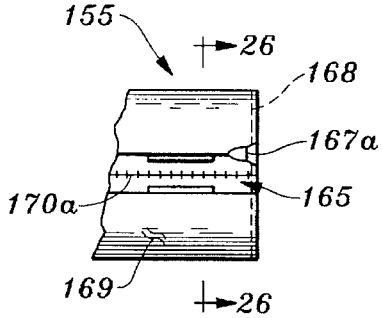
FIG. 25 is a partial side view of the bumper of FIG. 23 illustrating attachment of the hook sections of the Velcro type fastener to the side walls of the bumper via seams.
Figure 26:
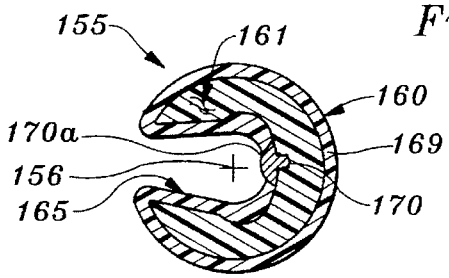
FIG. 26 is a section taken along line 26—26 of FIG. 25 showing an outer cover circumscribing an interior cushion.

FIGS. 24–26 show bumper 155 in more detail.

Each cover 160 of each bumper 155 is provided with a pair of end flaps 167 each sewn along a circumferential extending end seam 168 to a circumferential extending main section 169. As shown in FIG. 25, such end seam 168 attaches lapped side edges **167*a* of the end flap 167 and the main section 169 relative to each other. In turn, longitudinal edges 170 (see FIG. 26) of the main section 169 attach together along longitudinal seam 170*a***.

Figure 28:
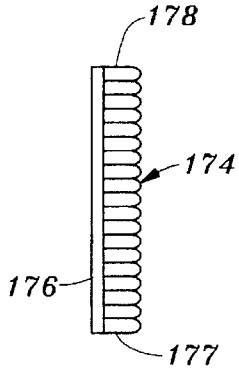
FIG. 28 is a section taken along line 28—28 of FIG. 27.
Figure 27:
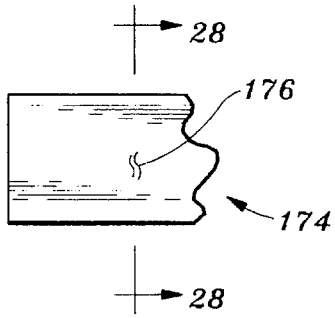
FIG. 27 is a detail of the loop section of the Velcro fastener of FIG. 23 prior to its attachment to the broad surface of the table of FIG. 23.

Returning to FIGS. 24 and 25, note that the wall surface 165 of the bumper 155 are provided with a series of rectangularly shaped hook sections 172 comprising the second elements of the Velco fasteners 166 previously mentioned with respect to FIG. 23. Attachment thereof is via a conventional adhesive at each undersurface 173 of each hook section 172. Returning to FIG. 23, note that associated loop section 174 of each Velco fastener 166 is attached to the table 150. Such attachments occur by removing or peeling off of tab covers 176, see FIGS. 27 and 28 to expose adhesive 177 at the underside 178 of the loop section 174 and then affixing the latter to the table 150. In turn, the associated loop sections 174 can be releasably attached to adjacently positioned hook sections 172, see FIGS. 24 and 25, whereby the bumper 155 can be attached to the table 150 to protect any falling child from injury by falling against same.

Figure 30:
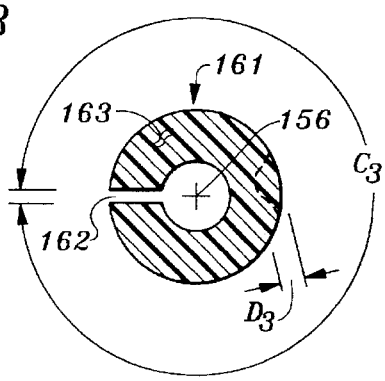
FIG. 30 is a section taken along line 30—30 of FIG. 29.

In this regard, note in FIGS. 24 and 30 that if the wall thickness T of the bumper 155 is 1.0 inches and has an active circumference of 9.42 inches, then the limit of radial elastic compressional deflection D3 of the bumper 155 toward its axis of formation 156 can be defined using ASTM's D-3574 procedure for measuring the resistance of plastic to deflection. Assuming that cushion 161 is composed of a polyeaster foam having a ASTM D-3574 compression number is a range of 70 to 85 with 75 to 80 being preferred, such as foam LA 80-400-815 manufactured by Crain Industries, San Leandro, Calif., then the compressional deflection D3 is always less than the wall thickness T. Hence, a child's anatomy is fully protected if the child's head, arm, chest etc. accidently comes into contact with the bumper of the invention.

While various embodiments have been set forth in considerable detail for the purposes of enabling those skilled in the art to practice the invention. It is apparent that numerous changes may be made in such details with departing from the spirit and principles of the invention.

For example, with respect to the bumper 155 of FIGS. 23–30, it is apparent that the shape thereof, could be varied, so as to include the linear construction akin to that shown in FIGS. 1–6, elbow type like that shown in FIGS. 7–12 and a circular type akin to that shown FIGS. 13–22. Furthermore, in system aspects of the invention, various lengths of different combinations of the embodiments of the invention could be used to provide full parameter protection of different table forms. For example, the parameter of a rectangular table could include four elbow types shown in FIGS. 7–12 and FIGS. 23–30 at the corners of the table, and a plurality of liner types of various lengths, say 12, 15, 18, 24 or 36 inches in lengths as shown in FIGS. 1–6 and FIGS. 23–30 between such corner to provide full parameter protection. Likewise, round tables could use the circular type shown in FIGS. 13–22 and FIGS. 23–30 of various lengths, say 12, 15, 18, 24 or 36 inches to provide similar, full parameter table protection.

What is claimed is:

1. A bumper for releasable attachment to a portion of an edge of a table to provide protection, comprising a modified cylindrical cushion means, a seamed cover circumscribing said cushion means, and a plurality of fasteners attached to said cover and adapted to be releasably attached about at least a portion of an edge of a table to provide edge protection thereof, said cushion means being composed of a foam plastic having a high ASTM D-3574 compression reflex number, and including (i) an outer arcuate surface defined by a common radius R centered on said axis of formation, (ii) a pair of end surfaces intersected by said axis of formation, (iii) first and second planar wall surfaces intersecting said outer arcuate surface and extending from said intersection therewith toward said axis of formation, thereby defining a cut-out opening of a length L that runs the entire length of said cushion means, said first and second planar wall surfaces being radially spaced apart a sufficient distance adjacent to said intersection with said arcuate surface, to permit attachment of said plurality of fasteners to a portion of said cover adjacent thereto, whereby said cover and said cushion means can be releasably attached about at least a portion of an edge of a table to provide edge protection thereto in the event of a child falling against said edge, said foam plastic being a high density polyester foam having a compression reflex number in a range of 70 to 85 whereby deflection is less than said radius R to protect against injury to a child's anatomy.

2. The bumper of claim 1 in which said reflex number range is more preferably from 75 to 80.

3. In a system for providing edge protection of furniture, a combination comprising a table having a broad horizontal surface terminating in a continuous parametric edge, a plurality of bumpers in end-to end contact with each other for releasable attachment about at least a portion of said parametric edge of said table to provide edge protection in the event of a child falling against such edge, each of said plurality of bumpers comprising a modified cylindrical cushion means, a seamed cover circumscribing said cushion means, and a plurality of fasteners attached to said cover and adapted to be releasably attached about at least a portion of an edge of a table to provide edge protection thereof, said cushion means being composed of foam plastic having a high ASTM D-3574 compression number, and including (i) an outer arcuate surface defined by a common radius R centered on said axis of formation, (ii) a pair of end surfaces intersected by said axis of formation, (iii) first and second planar wall surfaces intersecting said outer arcuate surface and extending from said intersection therewith toward said axis of formation, thereby defining a cut-out opening of a length L that runs the entire length of said cushion means, said first and second planar wall surfaces being radially spaced apart a sufficient distance adjacent to said intersection with said arcuate surface, to permit attachment of said plurality of fasteners to a portion of said cover adjacent thereto, whereby said cover and said cushion means can be releasably attached about at least a portion of an edge of a table to provide edge protection thereto in the event of a child falling against said edge, said foam plastic being a high density polyester foam having a compression reflex number in a range of 70 to 85 whereby compressional deflection is less than said radius R to protect against injury to a child's anatomy.

* * * * *